United States Patent [19]

Heimbrock

[11] Patent Number: 4,758,178

[45] Date of Patent: Jul. 19, 1988

[54] CLUSTER ASSEMBLY WITH LEAD SPACER

[75] Inventor: Henry H. Heimbrock, Cincinnati, Ohio

[73] Assignee: Standex International Corporation, Salem, N.H.

[21] Appl. No.: 88,971

[22] Filed: Aug. 24, 1987

Related U.S. Application Data

[63] Continuation of Ser. No. 835,170, Mar. 3, 1986, abandoned.

[51] Int. Cl.[4] ..... H01R 13/56; H01R 13/58

[52] U.S. Cl. ..... 439/458

[58] Field of Search ..... 339/105, 106; 439/453–459

[56] References Cited

U.S. PATENT DOCUMENTS

| | | | |
|---|---|---|---|
| 2,199,219 | 4/1940 | Edwards et al. | 339/105 |
| 4,114,971 | 9/1978 | Heimbrock | 339/59 R |
| 4,239,322 | 12/1980 | Gordon, Jr. | 339/105 |

FOREIGN PATENT DOCUMENTS

| | | | |
|---|---|---|---|
| 12177 | of 1911 | United Kingdom | 339/105 |
| 23534 | of 1914 | United Kingdom | 339/105 |
| 564419 | 9/1944 | United Kingdom | 339/105 |
| 1260298 | 1/1972 | United Kingdom | 339/105 |

*Primary Examiner*—John McQuade

*Attorney, Agent, or Firm*—Wood, Herron & Evans

[57] ABSTRACT

A cluster assembly for application to a three prong header from the interior of a hermetically-sealed compressor. The cluster assembly includes an insulated block having spaced parallel passages in which connector clips with leads attached are disposed. The block has flanges at the ends of the passageways from which the leads project, the flanges having notches. The leads are placed in the notches and are twisted to lie outside the surfaces of the block, the block when applied spacing the leads away from the compressor housing.

2 Claims, 1 Drawing Sheet

CLUSTER ASSEMBLY WITH LEAD SPACER

This application is a continuation of application Ser. No. 835,170 filed Mar. 3, 1986, now abandoned.

This invention relates to a cluster assembly for connecting three motor leads from a motor compressor to the three prongs of a header or glass-to-metal seal within the interior of a housing for a hermetically-sealed compressor. The cluster assembly may be of the type disclosed in U.S. Pat. No. 4,114,971, for example.

The environment in which the present invention is employed is the interior of a hermetically-sealed housing containing a motor-compressor unit for refrigerator or air conditioner. A three wire connection must be made to the motor. To this end, a three prong header or glass-to-metal seal is mounted in the housing wall with three prongs extending externally for application to a supply of power and three prongs extending internally for connection to the motor disposed in the housing.

The motor has three leads formed of magnet wire covered by insulative sheaths. These leads are terminated in clips adapted to be applied to the prongs of the header. The clips are mounted in a cluster block so that they are equiangularly disposed within the cluster block. The cluster block has spaced parallel passageways through which the leads pass.

In assembly, the header is mounted on a metal lid that will form a part of the housing. The assembler applies the cluster assembly to the internal prongs of the header. The lid is thereafter placed onto the rest of the housing and welded thereto complete the hermetic sealing of the housing around the motor and compressor.

It is desired to provide assurance that the leads will be spaced from the housing at all times, thereby avoiding possible abrasion of the varnish on the magnet wire and hence the possibility of a short circuit. To this end, the invention provides for the modification of the conventional cluster block in such a way as to effectively space the leads from the housing. More specifically, the invention provides for notched ears projecting from the surface of the cluster block, on the side remote from the housing when the block is applied. The ears permit the wires extending through the parallel passageways to be passed through the notches in the ears and the three wires twisted together immediately adjacent the block, thereby spacing the wires a significant distance from the housing. By way of example of the effectiveness of the invention, the wires as they project through the passageways in the cluster block normally lie about 1/16 inch from the surface of the cluster block facing the housing. When the invention is employed, the wires, now twisted and lying adjacent the opposite surface of the cluster block, are about 5/16 inch in distance from the same surface which faces the housing.

The several objectives and features of the invention will become more readily apparent from the following detailed description taken in conjunction with the accompanying drawings in which.

Figure 1:
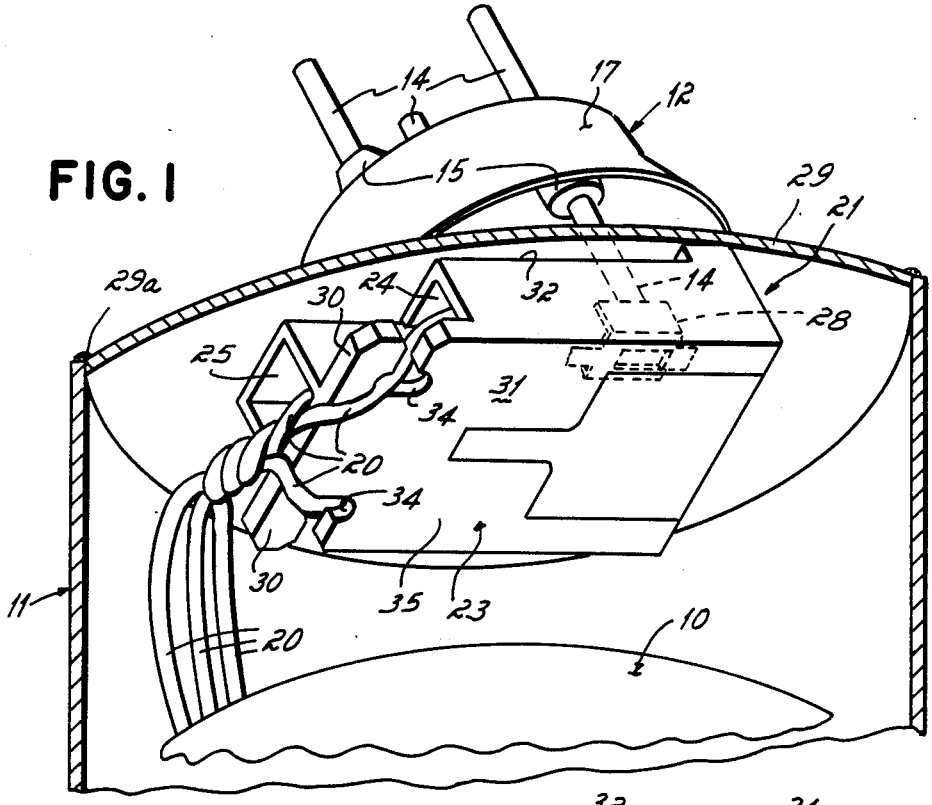
FIG. 1 is a fragmentary perspective view of the cluster assembly of the present invention applied to a header forming part of a hermetically-sealed compressor.
Figure 2:
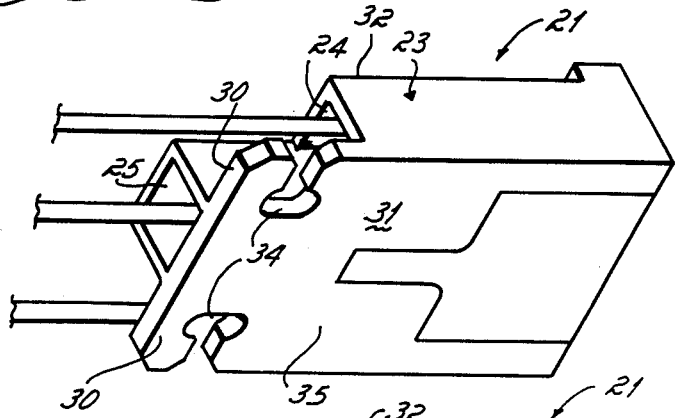
FIG. 2 is a perspective view of the cluster assembly.

Referring to FIG. 1, a motor-compressor unit 10 is mounted in a housing 11. Power is supplied to the motor through a header or glass-to-metal seal 12. The header consists of three conductive prongs 14 which are mounted in insulative material 15 and project through a metallic skirt 17. The metallic skirt is welded to the housing 11 with the prongs 14 projecting into the interior of the housing 11.

The motor-compressor 10 has three leads 20 which must be electrically connected to the prongs 14. To this end, the cluster assembly 21 is employed. The cluster assembly preferably is of the type disclosed in U.S. Pat. No. 4,114,971. The cluster assembly consists of an insulative block 23 having three longitudinal passages extending therethrough. The outboard passageways are indicated at 24 and a central passageway is indicated at 25.

In each passageway is a motor lead 20 and a clip 28. The clips 28 are forced over the inwardly-projecting prongs 14 of the header, thereby making the electrical connection of the motor-compressor to the externally-projecting prongs for application of power to the compressor.

It can be seen that leads 20 projecting through the passageways 24, 25 would normally lie quite close to the housing 11. Further, there must be slack in the leads between the cluster assembly and the motor-compressor unit 10. The slack is necessary to accommodate the assembly process in which a lid 29, on which the glass-to-metal seal is mounted, is initially separate from the housing. After the cluster assembly is applied to the prongs of the header 12, the lid is welded to the rest of the housing on the line 29a. The slack, referred to above, is necessary to permit the application of the header to the pins when the lid is initially free of the housing.

To keep that slack spaced from the surface of the housing, thereby preventing abrasion and short circuits, the invention provides two flanges 30. The flanges are generally an extension of the side 31 of the block 23 which is opposite the side 32 applied to the prongs 14 and facing the housing. Each flange has a keyhole notch 34 in which outboard lead wires 20 can be placed as they exit from the outboard passages 24. It can be seen from FIG. 1 that when those outboard leads are disposed in the notches 34, the leads lie outside of the remote surface 35 of the block 23 and are thus spaced away from the housing 11. The center lead passing through the center passageway 25 is twisted along with the outboard leads. Since the cluster block is about 5/16 inch thick, the notched ears increase the spacing of the three leads outside the surface 35 in a position spaced away from the housing 11.

Figure 3:
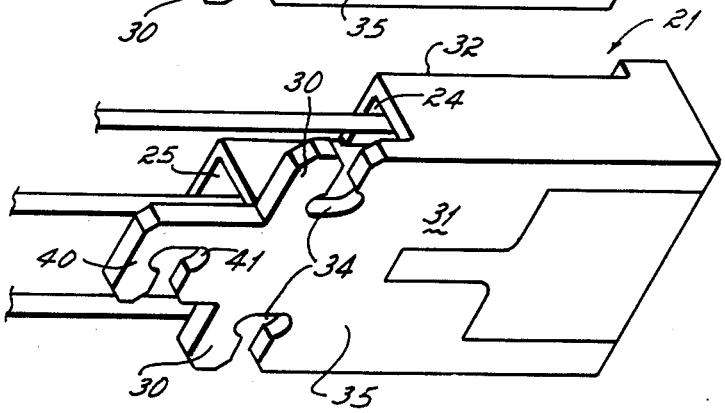
FIG. 3 is a perspective view of a modified cluster block.

While the drawings disclose two outboard flanges 30 with keyhole notches 34, it should be understood that a third central flange with similar keyhole notch could be employed to provide further assistance in spacing the leads as far away as possible from the housing 11. Such a structure is shown in FIG. 3. There, a central flange 40 having a notch 41 lies in the plane of the outboard flanges 30 and is aligned with the central passageway 25.

In practice, lead wires from all three passageways are passed upwardly through the respective notches 34 and 41 so as to extend beyond the surface 35. In this attitude, the wires are twisted together. The third central flange 40 thus provides a new factor against the inadvertent drooping of the central lead wire into contact with the housing.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1.

A cluster assembly adapted to be mounted on a three prong connector adjacent the internal surface of a housing for a motor-operated compressor comprising:

an insulative block having three spaced parallel passageways therein, said block having a surface normally lying adjacent said housing and an opposite surface spaced from said housing, connector clips disposed in said passageways, two outboard and a central magnet wire conductive leads connected to said clips and projecting through respective passageways from one end of said insulative block, said block having two flanges, one adjacent each corner of said block at the end from which said leads project, said flanges lying generally in the plane of said opposite surface, each said flange having a keyhole recess in an edge and two surfaces, an upper surface and a lower surface, said lower surface being coincident with the plane of said opposite surface, whereby each outboard lead extends from its respective passageway passing through a respective recess from a position adjacent said upper surface to a position adjacent said lower surface to lie outside the plane of said lower and said opposite surfaces such that said lead is directed away from said housing to prevent contact therewith and avoid abrasion of the varnish on said magnet wire which could result in a short circuit when said connector is mounted on said prongs, said leads being twisted together with said central lead to hold said central lead away from said housing.

2. A cluster assembly according to claim 1 further comprising:

a central flange and recess therein disposed on said block adjacent said central passageway and in the plane of said outboard flanges, said central lead being adapted to lie in the recess of the central flange.

* * * * *